US010520207B1

(12) United States Patent
Cheung et al.

(10) Patent No.: US 10,520,207 B1
(45) Date of Patent: Dec. 31, 2019

(54) REFRIGERATED DRYING MODULE FOR MOISTURE SENSITIVE DEVICE STORAGE

(71) Applicant: Flextronics AP, LLC, Broomfield, CO (US)

(72) Inventors: Dason Cheung, Fremont, CA (US); Murad Kurwa, San Jose, CA (US)

(73) Assignee: Flextronics AP, LLC, Broomfield, CO (US)

( * ) Notice: Subject to any disclaimer, the term of this patent is extended or adjusted under 35 U.S.C. 154(b) by 537 days.

(21) Appl. No.: 14/747,892

(22) Filed: Jun. 23, 2015

(51) Int. Cl.
*F24F 3/14* (2006.01)

(52) U.S. Cl.
CPC ..... *F24F 3/1405* (2013.01); *F24F 2003/144* (2013.01)

(58) Field of Classification Search
CPC ..... F24F 2003/144; F24F 3/1405
See application file for complete search history.

(56) References Cited

U.S. PATENT DOCUMENTS 2,089,776 A * 8/1937 Wittman ..... F24F 3/1411 62/176.5
3,128,158 A * 4/1964 Colvin ..... B63J 2/08 236/44 R
4,457,140 A * 7/1984 Rastelli ..... F25D 17/06 312/236
4,658,594 A * 4/1987 Langford ..... E04H 4/14 62/176.5
4,742,691 A * 5/1988 Kennedy ..... F24F 3/1405 62/150
5,361,511 A * 11/1994 Brown ..... D06F 58/206 34/468
5,831,830 A 11/1998 Mahler
6,615,596 B1 * 9/2003 Bass ..... F24F 3/1405 62/140
7,543,960 B2 6/2009 Chang
7,624,514 B2 * 12/2009 Konabe ..... F26B 3/205 34/86
7,746,639 B2 6/2010 Bopp
8,035,964 B2 10/2011 Biagini
2005/0066538 A1 * 3/2005 Goldberg ..... D06F 58/206 34/218
2005/0091993 A1 * 5/2005 Paradis ..... F24F 3/1405 62/93
2005/0204583 A1 * 9/2005 Kim ..... D06F 58/20 34/604
2007/0107255 A1 * 5/2007 Tamura ..... D06F 58/206 34/475

(Continued)

OTHER PUBLICATIONS

Non-Final Office Action dated Dec. 27, 2017; U.S. Appl. No. 14/310,733, filed Jun. 20, 2014, applicant; Mark Telefus, 24 pages.

*Primary Examiner* — Filip Zec
(74) *Attorney, Agent, or Firm* — Haverstock & Owens LLP

(57) ABSTRACT

A refrigerated drying module includes a storage cabinet for storing moisture sensitive devices, an air flow loop configured to circulate air into and out of the storage cabinet and a refrigerant loop configured to remove moisture from the air circulated through the air flow loop. The refrigerated drying module is configured to remove moisture from air drawn from the storage cabinet and collect the removed moisture as ice formed on the surface of an evaporator coil included in the refrigerant loop.

31 Claims, 4 Drawing Sheets

(56) References Cited

U.S. PATENT DOCUMENTS

| | | | | |
|---|---|---|---|---|
| 2008/0190121 | A1* | 8/2008 | Backman | F24F 3/153 62/115 |
| 2008/0245087 | A1* | 10/2008 | Orcutt | F25B 6/04 62/238.7 |
| 2009/0205354 | A1* | 8/2009 | Brown | F24F 3/1405 62/324.5 |
| 2010/0077775 | A1* | 4/2010 | Smith | F25D 17/042 62/93 |
| 2010/0269520 | A1* | 10/2010 | Moore | F24F 3/1405 62/89 |
| 2011/0146311 | A1* | 6/2011 | Thogersen | F25B 47/022 62/115 |
| 2012/0247135 | A1* | 10/2012 | Fakieh | E03B 3/28 62/129 |

* cited by examiner

REFRIGERATED DRYING MODULE FOR MOISTURE SENSITIVE DEVICE STORAGE

FIELD OF THE INVENTION

The present invention is generally directed to electronic device storage. More specifically, the present invention is directed to a refrigerated drying module for moisture sensitive device storage.

BACKGROUND OF THE INVENTION

Surface mount technology (SMT) is a mounting process where electronic components, such as integrated circuits (ICs), are mounted or placed directly onto the surface of printed circuit boards (PCBs). The SMT process may result in electronic component defects that can escape existing inspection and test processes, and may result in early life failure of systems using these defective electronic components. One type of damage is related to moisture sensitive devices, which include most ICs made with plastic or organic materials. This problem has been observed and documented since the early days of SMT technology and there are industrial standards that dictate the proper procedures. However, this failure often goes undetected.

Moisture sensitive devices are electronic components that absorb moisture and have a high potential for internal cracking during the assembly process such as during high temperature solder reflow process. All IC components are classified as moisture sensitive devices. Such electronic components are encapsulated with plastic compounds and other organic materials. Moisture from atmospheric humidity enters permeable packaging materials through diffusion. The moisture typically collects at dissimilar material interfaces within the packaging materials.

The electronic components are packaged prior to mounting on the PCB. During the SMT process, contacts on the electronic component are mounted to corresponding contact pads on the surface of the PCB. An electronic component may include short pins or leads of various styles, flat contacts, a matrix of solder balls (BGAs), or terminations on the body of the electronic component for interconnecting with the corresponding contact pads on the PCB. The contacts are connected to the contact pads using a solder reflow process. The high temperatures involved in vapor phase or reflow soldering may cause the absorbed moisture to expand rapidly, possibly causing internal stress known as "Popcorning" that causes package cracking. Surface peeling between the die pad and the resin is may also be caused by increased water vapor pressure. Surface delamination is may also result due to materials mismatch shear strain on bond wires and wire necking that leads to micro-cracking extending to the outside of the package. These internal defects due to moisture are nearly impossible to detect during the PCB assembly and test process. It is understood that such internal defects may be the result of any higher temperature processing step that is performed on a packaged electronic component.

According to the industrial standard, J-STD-033, Handling, Packing, Shipping and Use of Moisture/Reflow Sensitive Surface Mount Devices, a moisture sensitive device needs to be stored in an environment below 5% humidity to avoid moisture absorption and related thermal shock damage during the reflow process. To minimize moisture absorption, an exposure time of the moisture sensitive device must be controlled, where the exposure time is the time during which the moisture sensitive device is exposed to a higher humidity environment. It is a challenge to control the exposure time. Tracking exposure time involves a lot of paper work and handling. There is a software available in the market to keep track of the exposure time. However, if the exposure time is exceeded, then a baking process may be required to remove the excess moisture from the device. In addition to the cost associated with the baking process equipment, performing of the actual baking process will increase the risk of component oxidation.

A low humidity storage environment minimizes the moisture that can be absorbed and in some cases can remove some of the already absorbed moisture from the moisture sensitive device. A conventional low humidity storage environment is a dry storage box made of moisture diffusion-resistant walls. Inside the dry storage box is a desiccant. The moisture resistant device is placed inside the dry storage box. A downside is that the moisture resistant device must stay within the dry storage box for a relatively long time period, in some applications 2-3 hours. Another downside is that the desiccant periodically becomes saturated and either needs to be replaced or have the moisture removed. This results in a down period where the dry storage box can not be used for storing packaged electronic devices.

Another conventional low humidity storage environment is a nitrogen/dry air purge cabinet. Nitrogen does not absorb moisture and can function as a barrier to moisture. As such, the nitrogen protects the packaged electronic component from absorbing moisture outside the cabinet. However, any moisture already absorbed by the packaged electronic component cannot escape as the nitrogen forms a barrier around the package. Further, since the already absorbed moisture can not escape, the moisture will move toward the electronic component within the package. In this case, any subsequent cracking due to vapor expansion will occur near or at the electronic component, which is undesirable.

Yet another conventional low humidity storage environment is a vacuum sealed moisture barrier bag. Packaged electronic components are placed within the bag, along with a desiccant, and the bag is vacuum sealed. For low volume manufacturing, the bag is opened and one or more packaged electronic components are removed for assembly, while the remaining packaged electronic components are resealed in the bag, typically with a new desiccant. Some bags may not be resealable and a new bag may be needed. This is a time consuming and expensive process.

SUMMARY OF THE INVENTION

Embodiments are directed to a refrigerated drying module that includes a storage cabinet for storing moisture sensitive devices, an air flow loop configured to circulate air into and out of the storage cabinet and a refrigerant loop configured to remove moisture from the air circulated through the air flow loop. The refrigerated drying module is configured to remove moisture from air drawn from the storage cabinet and collect the removed moisture as ice formed on the surface of an evaporator coil included in the refrigerant loop.

In an aspect, a refrigerated drying module for providing a storage area having a low humidity environment is disclosed. The refrigerated drying module includes a storage cabinet, an air tube and a refrigerant loop. The air tube is coupled to the storage cabinet such that air circulates from the storage cabinet into the air tube and back into the storage cabinet. The refrigerant loop comprises an evaporator coil and refrigerant flowing through the evaporator coil. The evaporator coil is positioned within the air tube such that air circulating through the air tube passes over the evaporator coil and moisture within the air is collected as ice on the evaporator coil, thereby lowering a humidity level of the air circulating back into the storage cabinet. In some embodiments, the air tube comprises a first end and a second end, the first end configured to input air from the storage cabinet and the second end configured to output air back into the storage cabinet. In some embodiments, the refrigerated drying module also includes an air tube fan coupled to the air tube, wherein the air tube fan is configured to force air to circulate through the air tube. In some embodiments, the air tube comprises a drain valve. In some embodiments, the refrigerant loop further comprises a compressor, a condenser, an accumulator and a metering device. In some embodiments, the refrigerated drying module also includes a condenser fan coupled to the condenser. In some embodiments, the metering device comprises a capillary coil and an expansion valve. In some embodiments, the refrigerant loop is configured such that an evaporator coil surface has a temperature equal to or less than zero degrees Celsius such that the moisture within the circulating air freezes and is collected as ice on the evaporator coil. In some embodiments, the refrigerated drying module also includes a controller coupled to the refrigerant loop. In some embodiments, the refrigerated drying module also includes a heater coupled to the storage cabinet, wherein the heater is configured to regulate a temperature within the storage cabinet. In some embodiments, the refrigerated drying module also includes a temperature sensor coupled to the storage cabinet, wherein the temperature sensor is configured to sense a temperature within the storage cabinet. In some embodiments, the refrigerated drying module also includes a humidity sensor coupled to the storage cabinet, wherein the humidity sensor is configured to sense a humidity level within the storage cabinet. In some embodiments, the refrigerated drying module also includes an ice sensor coupled to the evaporator coil, wherein the ice sensor is configured to sense an amount of ice accumulated on the evaporator coil.

In another aspect, another refrigerated drying module for providing a storage area having a low humidity environment is disclosed. The refrigerated drying module includes a storage cabinet, a plurality of air tubes and a plurality of refrigerant loops. The plurality of air tubes is coupled to the storage cabinet such that air circulates from the storage cabinet into each air tube and back into the storage cabinet. The plurality of refrigerant loops each comprises an evaporator coil and refrigerant flowing through the evaporator coil. One evaporator coil from the plurality of refrigerant loops is positioned within a corresponding one air tube from the plurality of air tubes such that air circulating through each air tube passes over the evaporator coil and moisture within the air is collected as ice on the evaporator coil, thereby lowering a humidity level of the air circulating back into the storage cabinet. In some embodiments, each air tube comprises a first end and a second end, the first end configured to input air from the storage cabinet and the second end configured to output air back into the storage cabinet. In some embodiments, the refrigerated drying module also includes a plurality of air tube fans, one air tube fan coupled to a corresponding one air tube, wherein each air tube fan is configured to force air to circulate through the air tube. In some embodiments, each air tube comprises a drain valve. In some embodiments, the plurality of refrigerant loops each comprises a metering device, one metering device coupled to a corresponding one air tube. In some embodiments, the plurality of refrigerant loops further comprise a compressor, a condenser and an accumulator commonly coupled to the plurality of air tubes and the plurality of metering devices via branching tubes. In some embodiments, the plurality of refrigerant loops each further comprise valves for selectively enabling and preventing refrigerant flow through each refrigerant loop such that refrigerant flow is enabled through one or more evaporator coils while refrigerant flow is prevented in the remaining evaporator coils. In some embodiments, the refrigerated drying module also includes a condenser fan coupled to the condenser. In some embodiments, each metering device comprises a capillary coil and an expansion valve. In some embodiments, each refrigerant loop is configured such that an evaporator coil surface has a temperature equal to or less than zero degrees Celsius such that the moisture within the circulating air freezes and is collected as ice on the evaporator coil. In some embodiments, the refrigerated drying module also includes a controller coupled to the plurality of refrigerant loops. In some embodiments, the refrigerated drying module also includes a heater coupled to the storage cabinet, wherein the heater is configured to regulate a temperature within the storage cabinet. In some embodiments, the refrigerated drying module also includes a temperature sensor coupled to the storage cabinet, wherein the temperature sensor is configured to sense a temperature within the storage cabinet. In some embodiments, the refrigerated drying module also includes a humidity sensor coupled to the storage cabinet, wherein the humidity sensor is configured to sense a humidity level within the storage cabinet. In some embodiments, the refrigerated drying module also includes a plurality of ice sensor, one ice sensor coupled to a corresponding one evaporator coil, wherein each ice sensor is configured to sense an amount of ice accumulated on the evaporator coil.

BRIEF DESCRIPTION OF THE DRAWINGS

Several example embodiments are described with reference to the drawings, wherein like components are provided with like reference numerals. The example embodiments are intended to illustrate, but not to limit, the invention. The drawings include the following figures.

DETAILED DESCRIPTION OF THE EMBODIMENTS

Embodiments of the present application are directed to a refrigerated drying module. Those of ordinary skill in the art will realize that the following detailed description of the refrigerated drying module is illustrative only and is not intended to be in any way limiting. Other embodiments of the refrigerated drying module will readily suggest themselves to such skilled persons having the benefit of this disclosure.

Reference will now be made in detail to implementations of the refrigerated drying module as illustrated in the accompanying drawings. The same reference indicators will be used throughout the drawings and the following detailed description to refer to the same or like parts. In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application and business related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Figure 1:
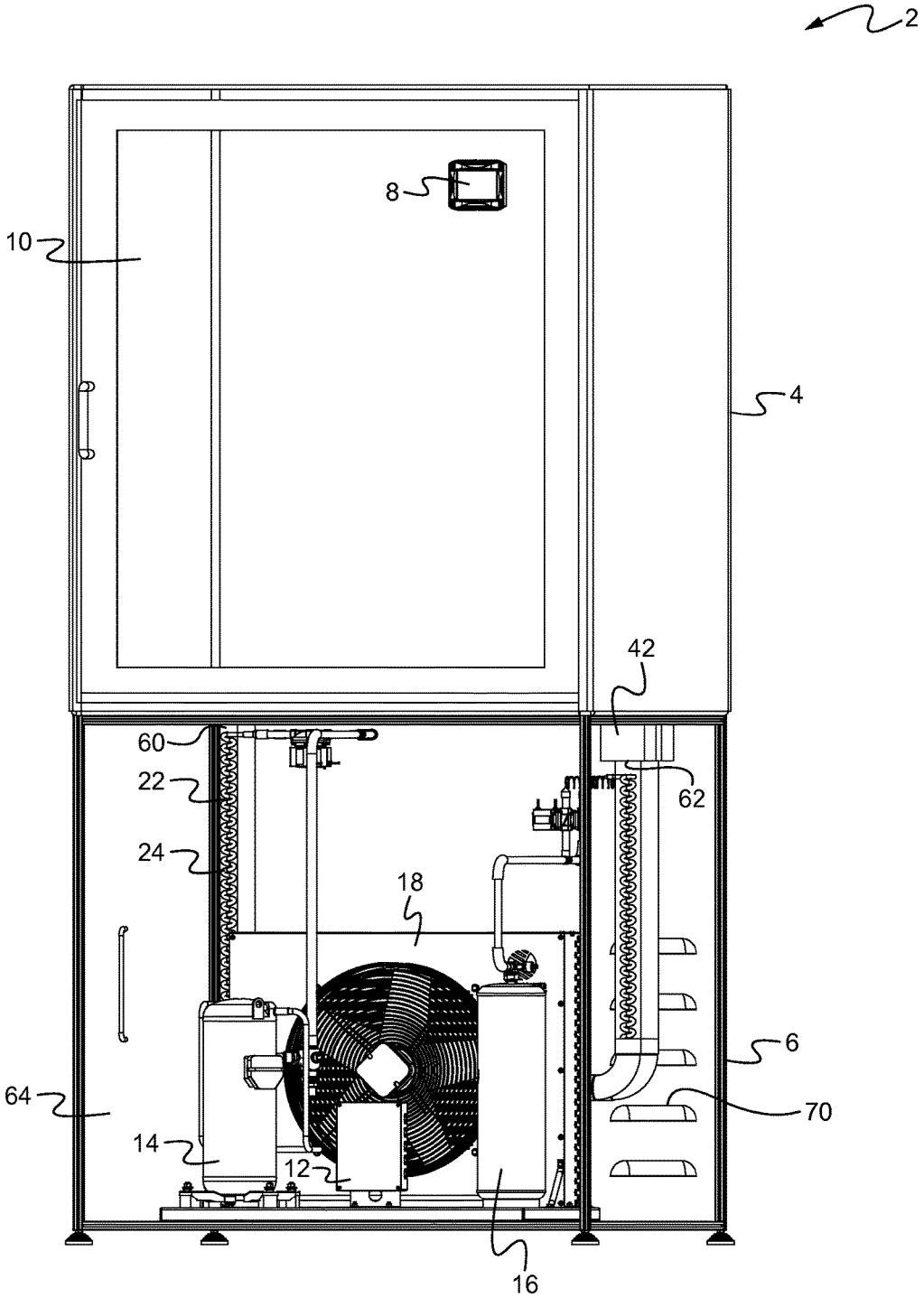
FIG. 1 illustrates a refrigerated drying module according to an embodiment.
Figure 2:
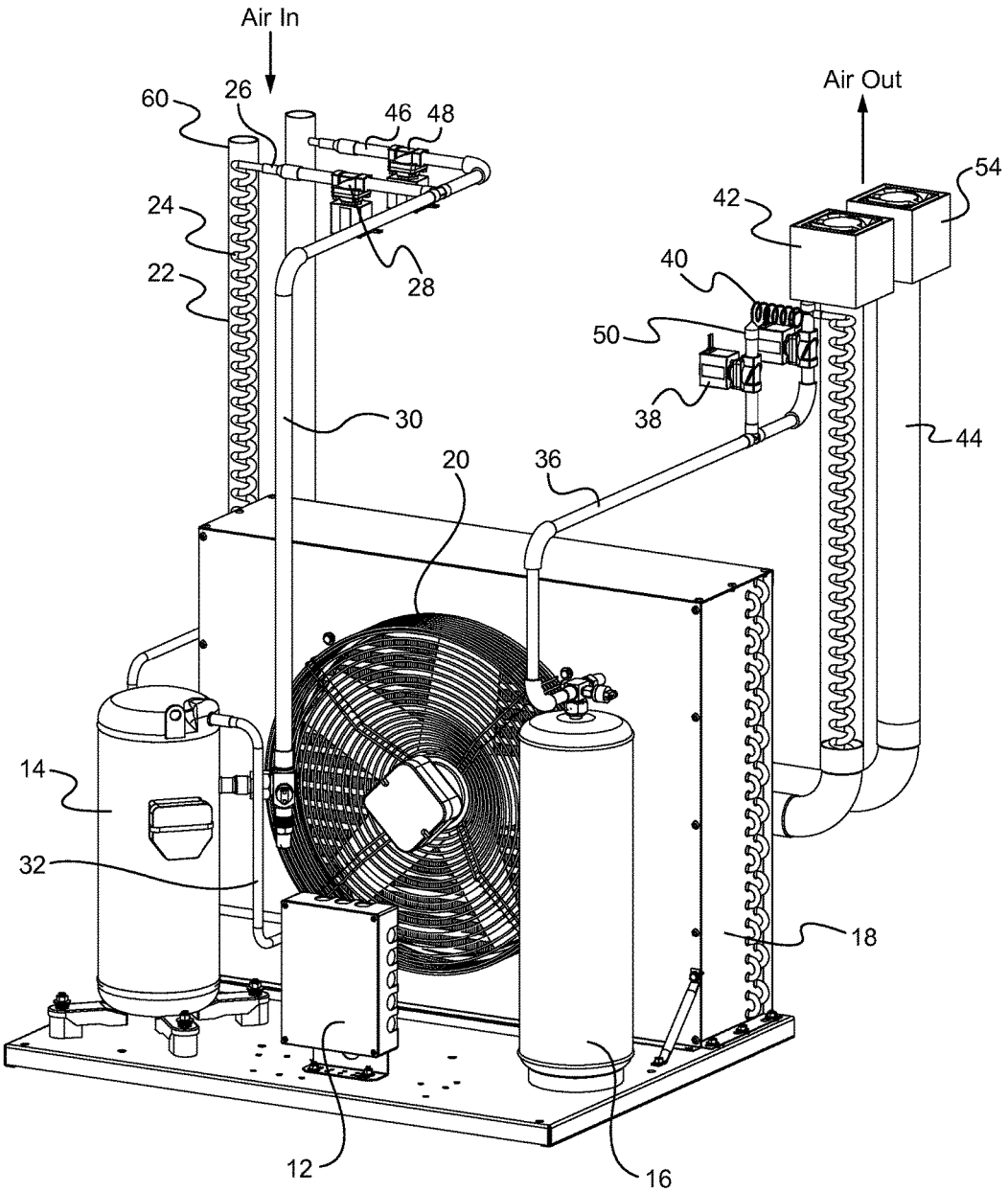
FIG. 2 illustrates a front perspective view of the equipment housed in the equipment cabinet 6 according to an embodiment.
Figure 4:
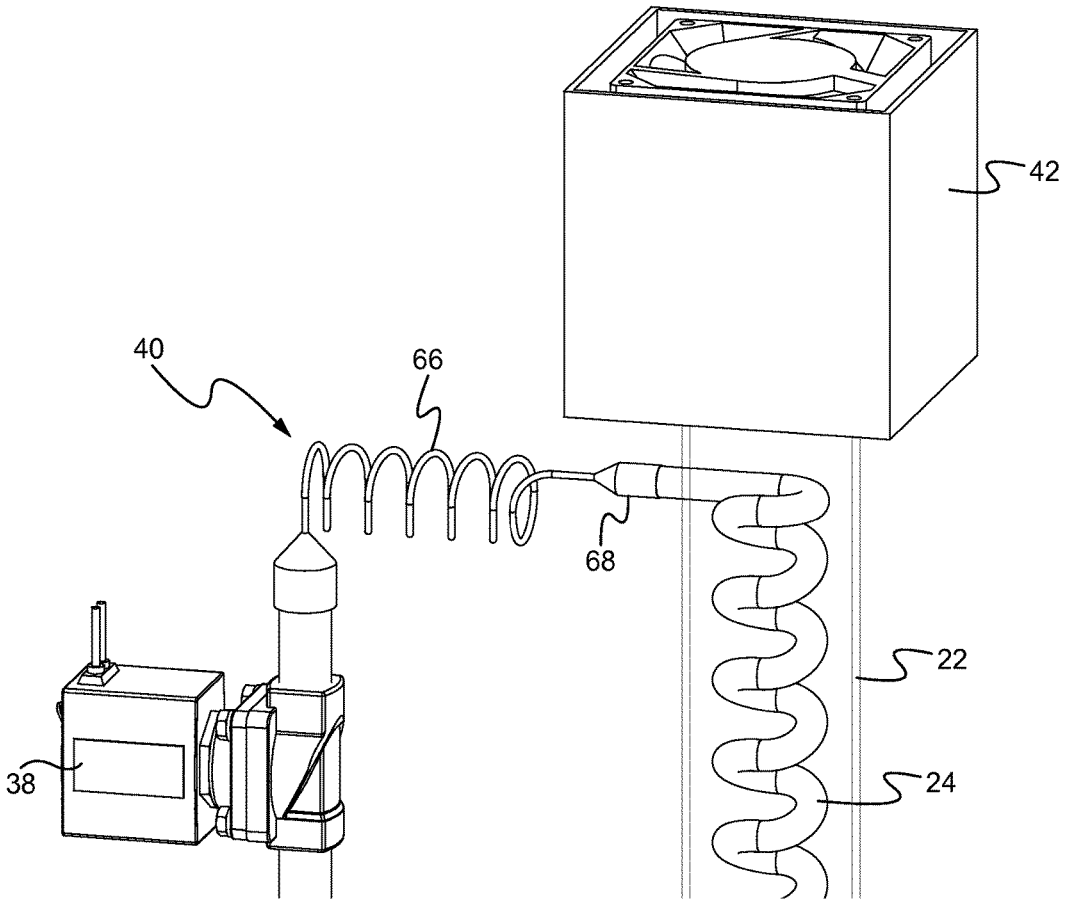
FIG. 4 illustrates a perspective view of the metering device according to an embodiment.

Embodiments are directed to a refrigerated drying module that includes a storage cabinet for storing moisture sensitive devices, an air flow loop configured to circulate air into and out of the storage cabinet and a refrigerant loop configured to remove moisture from the air circulated through the air flow loop. FIG. 1 illustrates a refrigerated drying module according to an embodiment. In this exemplary application, the refrigerated drying module 2 is configured as a cabinet. The refrigerated drying module 2 includes a storage cabinet 4 and an equipment cabinet 6. Moisture sensitive devices are stored in the storage cabinet 4. Access to the interior of the storage cabinet 4 can be provided by a door 10 which when closed provides a sealed environment within the storage cabinet 4. The equipment cabinet 6 houses the equipment used to dehumidify the air within the storage cabinet 4. Access to the interior of the equipment cabinet 6 can be provided by a door 64. A back wall of the equipment cabinet 6 can include grill 70 to enable air flow into and out of the interior or the equipment cabinet. In some embodiments, the front door 64 includes vents. In other embodiments, the front door 64 and/or the back wall of the equipment cabinet 6 are removed for improved air flow. A hollow air tube 22 includes a first end 60 and a second end 62. In some embodiments, the air tube 22 is U-shaped, as shown in FIGS. 1, 2 and 4. It is understood that the air tube 22 can be alternatively shaped. The first end 60 of the air tube 22 has a first opening and the second end 62 has a second opening. An air tube fan 42 is coupled to the second end 62 of the air tube 22. The storage cabinet 4 includes two openings, one opening to receive the first end 60 of the air tube 22 and another opening coupled to the air tube fan 42 such that the first opening in the first end 60 of the air tube 22 and the second opening in the second end 62 of the air tube 22 are each exposed to the ambient air within the storage cabinet 4. Air from the storage cabinet 4 is taken into the first opening of the air tube 22, flows through the air tube 22, and is output from the second opening in the air tube 22 through the air tube fan 42 back into the storage cabinet 4. In this manner an air flow loop is formed, where the air flow loop includes the storage cabinet 4, the air tube 22 and the air tube fan 42.

Figure 3:
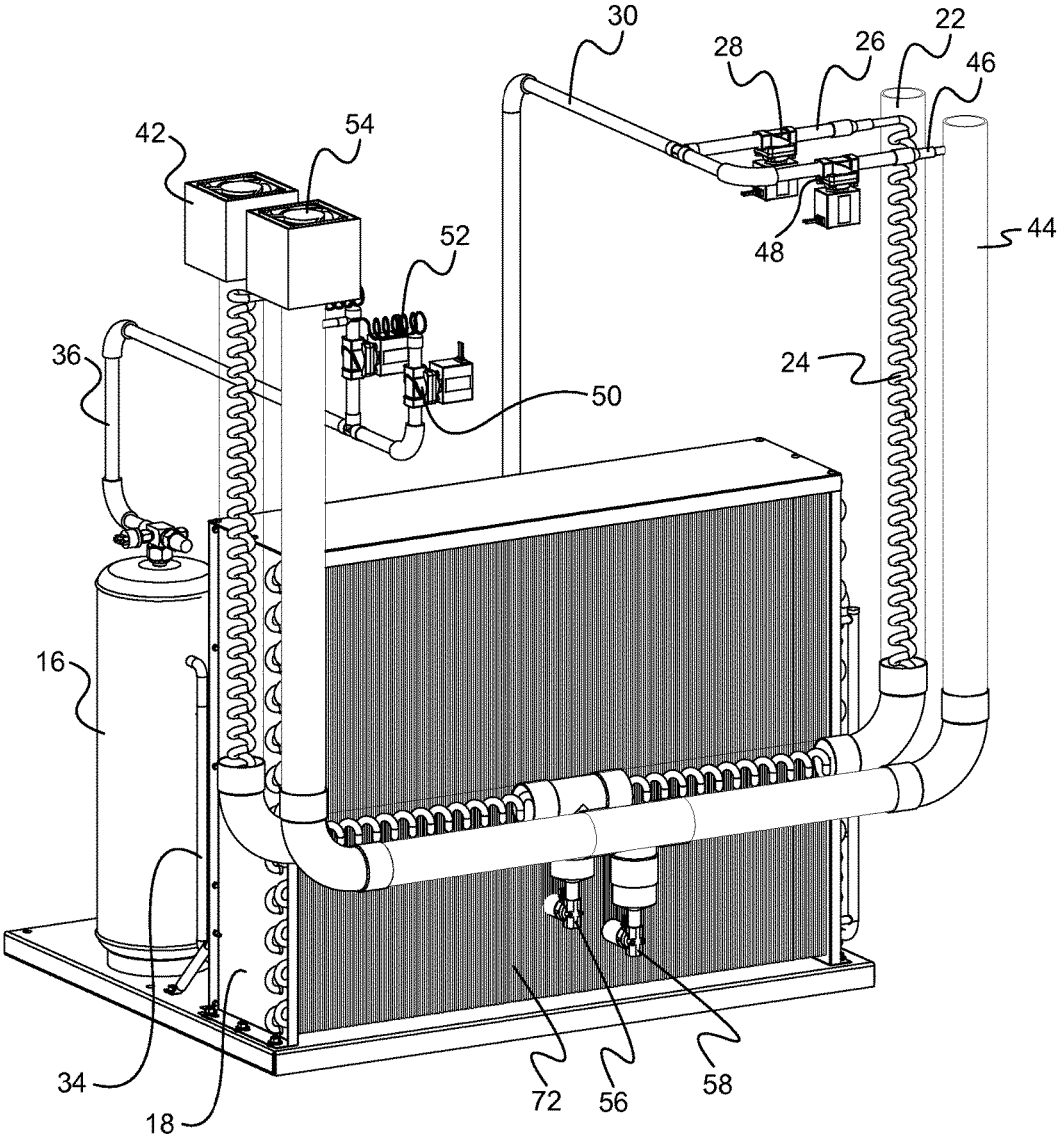
FIG. 3 illustrates a back perspective view of the equipment shown in FIG. 2.

Additional equipment housed in the equipment cabinet 6 includes a controller 12, a compressor 14, an accumulator 16, a condenser 18 and an evaporator coil 24. FIG. 2 illustrates a front perspective view of the equipment housed in the equipment cabinet 6 according to an embodiment. FIG. 3 illustrates a back perspective view of the equipment shown in FIG. 2. The evaporator coil 24 is positioned within the air tube. A first end of the evaporator coil 24 is coupled to the compressor 14 via a pipe 26, a valve 28 and a pipe 30. The compressor 14 is coupled to the condenser 18 via a pipe 32. The condenser 18 is coupled to the accumulator 16 via a pipe 34. The accumulator 16 is coupled to the metering device 40 via a pipe 36 and a valve 38. The metering device 40 is coupled to a second end of the evaporator coil 24. In this manner a refrigerant loop is formed, where the refrigerant loop includes the evaporator coil 24, the compressor 14, the condenser 18, the accumulator 16, the metering device 40, and the interconnecting pipes and valves. It is understood that the number and configuration of pipes and valves shown in FIGS. 2 and 3 is for exemplary purposes only and that alternative configurations are also contemplated for interconnecting the evaporator coil 24, the compressor 14, the condenser 18, the accumulator 16 and the metering device 40.

The evaporator coil 24 is positioned within the air tube 22 such that air taken into the air tube 22 passes over the evaporator coil 24. Refrigerant circulates through the evaporator coil 24. The type of refrigerant and the pressure of the refrigerant within the evaporator coil 24 are chosen such that a temperature at the evaporator coil surface is equal to or less than zero degrees Celsius. As air passes over the evaporator coil 24, moisture (water molecules) contacting the evaporator coil surface freezes thereby collecting ice on the evaporator coil 24 and extracting the moisture from the air.

Ice forms on the evaporator coil 24 until a maximum amount of ice is accumulated. As this point a defrosting process is performed. A drain valve 56 is coupled to the air tube 22. The compressor 14 is turned OFF and the drain valve 56 is opened. Turning OFF the compressor 14 stops the flow of the refrigerant through the evaporator coil 24. As a result the temperature at the surface of the evaporator coil 24 rises and the ice begins to melt. The melted ice drains out of the air tube 22 via the open drain valve 56. Once the ice is melted, either completely or partially, the drain valve 56 is closed and the compressor 14 is turned back ON. In some embodiments, a sensor is used to determine the amount of ice formed on the evaporator coil 24 and whether or not the defrosting process needs to be performed.

The refrigerant is in various phases as it flows through the refrigerant loop. Circulating refrigerant vapor enters the compressor 14 and is compressed to a higher pressure, resulting in a higher temperature as well. The compressed refrigerant vapor is now at a temperature and pressure at which it can be condensed and is routed through the condenser 18. In the condenser, the compressed refrigerant vapor flows through condenser coils. The condenser fan 20 blows air across the condenser coils and out grills 72 thereby transferring heat from the compressed refrigerant vapor to the flowing air. Cooling the compressed refrigerant vapor condenses the vapor into a liquid. The condensed refrigerant liquid is output from the condenser 18 to the accumulator 16 where the condensed refrigerant liquid is pressurized. The condensed and pressurized refrigerant liquid is output from the accumulator 18 and routed through the metering device 40 where it undergoes an abrupt reduction in pressure. That pressure reduction results in flash evaporation of a part of the liquid refrigerant, lowering its temperature. The cold refrigerant liquid/vapor is then routed through the evaporator coil 24. The result is a mixture of liquid and vapor at a lower temperature and pressure. The cold refrigerant liquid-vapor mixture flows through the evaporator coil 24 and is completely vaporized by cooling the surface of the evaporator coil 24 and freezing moisture contacting the evaporator coil surface. The resulting refrigerant vapor returns to the compressor 14 to complete the cycle.

The metering device 40 is used to convert the liquid phase refrigerant to a liquid/vapor phase refrigerant. In some embodiments, the metering device 40 is a capillary coil. FIG. 4 illustrates a perspective view of the metering device according to an embodiment. The exemplary metering device 40 includes a capillary coil 66 that has an output end 68 with a diameter that is greater than a diameter of the previous portion of the coil such that a pressure abruptly decreases, causing flash evaporation of a portion of the refrigerant. As such, a liquid/vapor phase refrigerant is output from the capillary coil 66 and into the evaporator coil 24. The length and diameter of the capillary coil 66 are selected to achieve a specific refrigerant pressure within the evaporator coil 24. The type of refrigerant is selected along with the refrigerant pressure to achieve a specific temperature on the outer surface of the evaporator coil 24. In an exemplary application, the capillary coil inside diameter is 0.064 inches, the capillary coil length is 10 feet, the refrigerant is R22 and the compressor 14 is a 1 horsepower compressor, which results in an evaporator coil surface temperature of about −23 to about −15 degree Celsius.

In some embodiments, additional refrigerant loops and air flow loops are included in the system. A single compressor, condenser and accumulator can be connected to several different evaporator coils, each evaporator coil positioned within its own air tube. In some embodiments, all evaporator coils are operated concurrently and each evaporator coil and corresponding air tube can be positioned to control the humidity in different compartments within the same drying cabinet or to control the humidity in different cabinets. In other embodiments, one or more additional evaporator coils are for redundancy or for maintaining operation of the system while another evaporator coil is defrosted. This feature enables continuous operation of the system while enabling periodic defrosting of the evaporator coils. In the exemplary configuration shown in FIGS. 1-3, the refrigerated drying module 2 includes a second evaporator coil (not shown) positioned within a second air tube 44 in a similar manner as the evaporator coil 24 positioned within the air tube 22. A first end of the second evaporator coil in the air tube 44 is coupled to a pipe 46. The pipe 46 is coupled to a valve 48. The pipe 30 branches in two, a first branch is coupled to the valve 28 and a second branch is coupled to the valve 48. A second end of the second evaporator coil is coupled to a metering device 52. The metering device 52 is coupled to a valve 50. The pipe 36 branches in two, a first branch is coupled to the valve 38 and a second branch is couple to the valve 50. The second air tube 44 also includes a drain valve 58. In this manner, two refrigerant loops are formed. The first refrigerant loop is formed as described above and includes the evaporator coil 24, the compressor 14, the condenser 18, the accumulator 16, the metering device 40, and the interconnecting pipes and valves. The second refrigerant loop includes the second evaporator coil in the air tube 44, the compressor 14, the condenser 18, the accumulator 16, the metering device 40, and the interconnecting pipes and valves. Two air flow loops are also formed. The first air flow loop is formed as described above and includes the storage cabinet 4, the air tube 22 and the air tube fan 42. The second air flow loop includes the storage cabinet 4, the air tube 44 and an air tube fan 54 coupled to the air tube 44. When the first refrigerant loop is in operation, the air tube fan 42 is turned ON to force airflow through the first air flow loop, and when the second refrigerant loop is in operation, the air tube fan 54 is turned ON to force airflow through the second air flow loop. In some applications, both the first and second refrigerant loops are operated concurrently. In this case, the valves 28, 38, 48 and 50 are all open and refrigerant flows concurrently through both the evaporator coil 24 and the second evaporator coil in the air tube 44. In other applications, the first refrigerant loop is in operation while the second refrigerant loop is not, and vice-versa. For example, to operate the first refrigerant loop but not the second refrigerant loop, the valves 28 and 38 are open and the valves 48 and 50 are closed. In such applications, one of the refrigerant loops can always be in operation, thereby enabling the other refrigerant loop to go offline for defrosting. The second refrigerant loop can also be used as a back up in case the first refrigerant loop becomes inoperable.

In some embodiments, the drying cabinet also includes a heater for controlling a temperature within the drying cabinet. The drying cabinet also includes a humidity sensor and a temperature sensor. The drying cabinet can also include a door sensor to sense whether or not the door is open.

The controller 12 is electrically coupled to the system components to control the air flow loop, the refrigerant loop and the heater. The controller 12 also connected to the sensors to receive sensed data. In some embodiments, the controller is also electrically coupled to the valves in the refrigerant loop and the drain valve to control opening and closing of the valves. The refrigerated drying module 2 also includes a user interface 8 for displaying humidity and temperature readings from within the storage cabinet 4. The user interface 8 can also display other information related to the operation and status of the refrigerated drying module 2, as well as provide means for interfacing with the controller 12 and controlling operation of the refrigerated drying module 2. In some embodiments, access to the controller 12 is provided by a network, wired or wireless, coupled to the controller 12.

The humidity level within the drying cabinet can be adjusted. In the example above, the humidity target is below 5%. In other applications, the humidity target can be more or less than 5%. The humidity target level can be adjusted by using specific combinations of refrigerant type, pressure of refrigerant within the evaporator coil and air flow rate through the air tube. As previously described, the type of refrigerant and the pressure of the refrigerant within the evaporator coil determines a surface temperature of the evaporator coil. Changing of this surface temperature impacts where within the air tube ice tends to form on the evaporator coil. For example, the colder the surface temperature of the evaporator coil, the faster moisture tends to freeze and therefore the closer to the air intake end of the air tube ice tends to form on the evaporator coil. A higher surface temperature tends to lead to ice formation on portions of the evaporator coil that are further from the air intake end of the air tube and closer to the air output end of the air tube.

The temperature within the drying cabinet can be adjusted by controlling the heater coupled to the drying cabinet. Independent control of both the humidity and the temperature enables controlled combinations of various application specific temperature and humidity specifications.

The refrigerated drying module is described above as being applied to moisture sensitive devices. It is understood that the refrigerated drying module can be applied generally to any device requiring exposure to a low humidity environment.

The present application has been described in terms of specific embodiments incorporating details to facilitate the understanding of the principles of construction and operation of the refrigerated drying module. Many of the components shown and described in the various figures can be interchanged to achieve the results necessary, and this description should be read to encompass such interchange as well. As such, references herein to specific embodiments and details thereof are not intended to limit the scope of the claims appended hereto. It will be apparent to those skilled in the art that modifications can be made to the embodiments chosen for illustration without departing from the spirit and scope of the application.

What is claimed is:

1. A refrigerated drying module for providing a storage area having a low humidity environment, the refrigerated drying module comprising:

a. a storage cabinet comprising a storage cabinet housing;

b. an air tube coupled to the storage cabinet such that air circulates from the storage cabinet into the air tube and back into the storage cabinet, wherein at least a portion of the air tube is external to the storage cabinet housing;

c. a refrigerant loop comprising an evaporator coil and refrigerant flowing through the evaporator coil, wherein the evaporator coil is positioned within the air tube such that air circulating through the air tube passes over the evaporator coil and moisture within the air is collected as ice on the evaporator coil, thereby lowering a humidity level of the air circulating back into the storage cabinet, further wherein a remaining portion of the refrigeration loop is exterior to the air tube.

2. The refrigerated drying module of claim 1 wherein the storage cabinet is enclosed except for air tube openings in the storage cabinet housing, further wherein the air tube comprises a first end and a second end, the first end is coupled to a first air tube opening in the storage cabinet housing and is configured to input air from the storage cabinet and the second end is coupled to a second air tube opening in the storage cabinet housing and is configured to output air back into the storage cabinet, further wherein the air tube and the storage cabinet form a closed-loop air flow loop.

3. The refrigerated drying module of claim 1 further comprising an air tube fan coupled to the air tube, wherein the air tube fan is configured to force air to circulate through the air tube.

4. The refrigerated drying module of claim 1 wherein the air tube comprises a drain valve.

5. The refrigerated drying module of claim 1 wherein the remaining portion of the refrigerant loop comprises a compressor, a condenser, an accumulator and a metering device.

6. The refrigerated drying module of claim 5 further comprising a condenser fan coupled to the condenser.

7. The refrigerated drying module of claim 5 wherein the metering device comprises a capillary coil and an expansion valve.

8. The refrigerated drying module of claim 1 wherein the refrigerant loop is configured such that an evaporator coil surface has a temperature equal to or less than zero degrees Celsius such that the moisture within the circulating air freezes and is collected as ice on the evaporator coil.

9. The refrigerated drying module of claim 1 further comprising a controller coupled to the refrigerant loop, wherein the controller, the storage cabinet, the air tube and the refrigerant loop are configured to control a humidity level within the storage cabinet below a predetermined value.

10. The refrigerated drying module of claim 1 further comprising a heater coupled to the storage cabinet, wherein the heater is configured to regulate a temperature within the storage cabinet.

11. The refrigerated drying module of claim 1 further comprising a temperature sensor coupled to the storage cabinet, wherein the temperature sensor is configured to sense a temperature within the storage cabinet.

12. The refrigerated drying module of claim 1 further comprising a humidity sensor coupled to the storage cabinet, wherein the humidity sensor is configured to sense a humidity level within the storage cabinet.

13. The refrigerated drying module of claim 1 further comprising an ice sensor coupled to the evaporator coil, wherein the ice sensor is configured to sense an amount of ice accumulated on the evaporator coil.

14. The refrigerated drying module of claim 1 wherein all portions of the air tube within which the evaporator coil is positioned are completely external to the storage cabinet housing.

15. A refrigerated drying module for providing a storage area having a low humidity environment, the refrigerated drying module comprising:

a. a storage cabinet comprising a storage cabinet housing;

b. a plurality of air tubes coupled to the storage cabinet such that air circulates from the storage cabinet into each air tube and back into the storage cabinet, wherein at least a portion of each air tube is external to the storage cabinet housing;

c. a plurality of refrigerant loops each comprising an evaporator coil and refrigerant flowing through the evaporator coil, wherein one evaporator coil from the plurality of refrigerant loops is positioned within a corresponding one air tube from the plurality of air tubes such that air circulating through each air tube passes over the evaporator coil and moisture within the air is collected as ice on the evaporator coil, thereby lowering a humidity level of the air circulating back into the storage cabinet, further wherein a remaining portion of the plurality of refrigeration loops is exterior to the plurality of air tubes.

16. The refrigerated drying module of claim 15 wherein the storage cabinet is enclosed except for air tube openings in the storage cabinet housing, further wherein each air tube comprises a first end and a second end, the first end is coupled to a first air tube opening in the storage cabinet housing and is configured to input air from the storage cabinet and the second end is coupled to a second air tube opening in the storage cabinet housing and is configured to output air back into the storage cabinet, further wherein the air tube and the storage cabinet form a closed-loop air flow loop.

17. The refrigerated drying module of claim 15 further comprising a plurality of air tube fans, one air tube fan coupled to a corresponding one air tube, wherein each air tube fan is configured to force air to circulate through the air tube.

18. The refrigerated drying module of claim 15 wherein each air tube comprises a drain valve.

19. The refrigerated drying module of claim 15 wherein the plurality of refrigerant loops each comprises a metering device, one metering device coupled to a corresponding one air tube.

20. The refrigerated drying module of claim 19 wherein the plurality of refrigerant loops further comprises a compressor, a condenser and an accumulator commonly coupled to the plurality of air tubes and the plurality of metering devices via branching tubes, and the remaining portion of the plurality of refrigeration loops comprises the compressor, the condenser, the accumulator and the plurality of metering devices.

21. The refrigerated drying module of claim 20 wherein the plurality of refrigerant loops each further comprise valves for selectively enabling and preventing refrigerant flow through each refrigerant loop such that refrigerant flow is enabled through one or more evaporator coils while refrigerant flow is prevented in the remaining evaporator coils.

22. The refrigerated drying module of claim 20 further comprising a condenser fan coupled to the condenser.

23. The refrigerated drying module of claim 19 wherein each metering device comprises a capillary coil and an expansion valve.

24. The refrigerated drying module of claim 15 wherein each refrigerant loop is configured such that an evaporator coil surface has a temperature equal to or less than zero degrees Celsius such that the moisture within the circulating air freezes and is collected as ice on the evaporator coil.

25. The refrigerated drying module of claim 15 further comprising a controller coupled to the plurality of refrigerant loops, wherein the controller, the storage cabinet, the plurality of air tubes and the plurality of refrigerant loops are configured to control a humidity level within the storage cabinet below a predetermined value.

26. The refrigerated drying module of claim 15 further comprising a heater coupled to the storage cabinet, wherein the heater is configured to regulate a temperature within the storage cabinet.

27. The refrigerated drying module of claim 15 further comprising a temperature sensor coupled to the storage cabinet, wherein the temperature sensor is configured to sense a temperature within the storage cabinet.

28. The refrigerated drying module of claim 15 further comprising a humidity sensor coupled to the storage cabinet, wherein the humidity sensor is configured to sense a humidity level within the storage cabinet.

29. The refrigerated drying module of claim 15 further comprising a plurality of ice sensor, one ice sensor coupled to a corresponding one evaporator coil, wherein each ice sensor is configured to sense an amount of ice accumulated on the evaporator coil.

30. The refrigerated drying module of claim 25 wherein each of the plurality of refrigerant loops further comprises a valve for regulating the flow of refrigerant through the refrigerant loop, and the controller is coupled to the valve in each of the plurality of refrigerant loops, further wherein the valve is set in each refrigerant loop to enable refrigerant flow in all of the plurality of refrigerant loops during a normal mode, whereas in a defrosting mode the valve in at least one of the refrigerant loops is set to disable refrigerant flow in the at least one refrigerant loop to defrost the evaporator coil in the at least one refrigerant loop while the valve in at least one other of the refrigerant loops remains set to enable refrigerant flow in the at least one other refrigerant loop.

31. A refrigerated drying module for providing a storage area having a low humidity environment, the refrigerated drying module comprising:

a. a storage cabinet;

b. an air tube coupled to the storage cabinet such that air circulates from the storage cabinet into the air tube and back into the storage cabinet;

c. a refrigerant loop comprising an evaporator coil and refrigerant flowing through the evaporator coil, wherein the evaporator coil is positioned within the air tube such that air circulating through the air tube passes over the evaporator coil and moisture within the air is collected as ice on the evaporator coil, thereby lowering a humidity level of the air circulating back into the storage cabinet, further wherein a remaining portion of the refrigeration loop is exterior to the air tube;

d. a humidity sensor positioned within the storage cabinet and external to the air tube, wherein the humidity sensor is configured to sense a humidity level within the storage cabinet;

e. an air tube fan coupled to the air tube, wherein the air tube fan is configured to force air to circulate through the air tube; and f. a controller coupled to the refrigerant loop, the humidity sensor, and the air tube fan, wherein the controller is configured to control a humidity level within the storage cabinet to a predetermined level by sensing the humidity level in the storage cabinet according to the humidity sensor and controlling the air tube fan to adjust an airflow rate through the air tube.

* * * * *